US005829504A

United States Patent [19]

Ekstrand et al.

[11] Patent Number: 5,829,504

[45] Date of Patent: Nov. 3, 1998

[54] DOOR EDGE GUIDING ARRANGEMENT

[75] Inventors: Marie Ingela Christina Ekstrand; Hans-Inge Bertilsson; Nils Håkan Ivar Larsson, all of Halmstad, Sweden

[73] Assignee: Nomafa AB, Halmstad, Sweden

[21] Appl. No.: 669,554

[22] PCT Filed: Jan. 17, 1995

[86] PCT No.: PCT/SE95/00037

§ 371 Date: Jul. 26, 1996

§ 102(e) Date: Jul. 26, 1996

[87] PCT Pub. No.: WO95/19487

PCT Pub. Date: Jul. 20, 1995

[30] Foreign Application Priority Data

Jan. 17, 1994 [SE] Sweden ..... 9400107

[51] Int. Cl.[6] ..... E05D 15/06

[52] U.S. Cl. ..... 160/201; 160/274; 160/277; 160/278; 49/197

[58] Field of Search ..... 160/201, 274, 160/277, 278, 267.1, 272, 270; 49/9, 197, 199

[56] References Cited

U.S. PATENT DOCUMENTS

| | | | |
|---|---|---|---|
| 867,850 | 10/1907 | Sturgis | 160/278 |
| 2,059,833 | 11/1936 | Winn, Jr. | 160/201 |
| 2,837,151 | 6/1958 | Stroup | 160/201 |
| 3,412,780 | 11/1968 | Moler | 160/201 |
| 3,441,076 | 4/1969 | Glejf et al. | 160/201 |
| 3,493,032 | 2/1970 | Brown, Jr. et al. | 160/201 |
| 3,552,474 | 1/1971 | Finnegan | 160/201 |
| 3,750,739 | 8/1973 | McGuire | 49/9 X |
| 4,120,072 | 10/1978 | Hormann | 160/201 X |
| 4,572,268 | 2/1986 | Wentzel | 160/201 |
| 4,846,245 | 7/1989 | Pagliaro et al. | 160/201 X |

*Primary Examiner*—Daniel P. Stodola
*Assistant Examiner*—Bruce A. Lev
*Attorney, Agent, or Firm*—Kane, Dalsimer, Sullivan, Kurucz, Levy, Eisele and Richard, LLP

[57] ABSTRACT

The apparatus relates, according to a first aspect, to an edge guiding arrangement, for a door having a plurality of mutually rotatable panels (2) which are extended between and movable along two elongate guides (4) at opposite edge portions (8) of the panels (2). The edge guiding arrangement comprises such a guide (4), a guide device (16) engaging and being movable along the guide (4), and a joint between the guide device (16) and an edge portion of a panel (2). The edge guiding arrangement is characterised in that the guide device (16) is rotatable relative to the guide (4) in a plane (P) perpendicular to the longitudinal direction of the guide (4), and that the joint between the guide device (16) and the panel (2) is resiliently flexible in said plane (P). The apparatus relates, according to a second aspect, to an edge guiding arrangement designed for such a door and characterised in that the engagement between the guide device and the guide is such that the guide device (16) can be disengaged from the guide (4) upon a sufficiently great impact on the door.

21 Claims, 4 Drawing Sheets

DOOR EDGE GUIDING ARRANGEMENT

BACKGROUND OF THE INVENTION

1. Field of the Invention

The present invention generally relates to an edge guiding arrangement for a door having a plurality of mutually rotatable panels which are extended between and movable along two elongate guides at opposite edge portions of the panels, the edge guiding arrangement comprising such a guide, a guide means engaging and movable along the guide, and a joint between the guide means and an edge portion of a panel.

2. Description of the Prior Art

The edge guiding arrangement according to the invention is specifically, but not exclusively, usable in connection with an impact-resistant door leaf of the type disclosed in SE 9400106-2, which is made up of flexible panels and flexible, continuous, dividable link elements between the panels.

WO 93/16262 shows an example of a traditional design of an edge guiding arrangement of the above-mentioned type, where the guides consist of two substantially U- or C-shaped guide rails, the guide means consist of guide rollers engaging and running in the guide rails, and where the joints between the guide means and the edge portions of the panels consist of shafts forming axes of rotation of the guide rollers and hinge pins in hinges which are fixedly mounted on the panels for rotatable interconnection of adjoining panels.

U.S. Pat. No. 3,140,508 shows a similar solution, where the joints between the panels and the guide rollers instead consist of plate-shaped mounting elements.

U.S. Pat. No. 3,484,812 describes an edge guiding arrangement for an overhead sliding door, where the guide also consists of a substantially C-shaped guide rail, the guide means consists of a guide roller engaging and running in the guide rail, and where the joint between the guide roller and the panel edge portion consists of a shaft, on one end of which the guide roller is mounted. The other end of the shaft is connected to and axially movable back and forth relative to a mounting element on the panel edge portion. If the panel is displaced sideways away from the guide rail and the shaft is thus displaced axially relative to the mounting element to an end position, the shaft is able, together with the guide roller, to rotate in a plane perpendicular to the longitudinal direction of the guide rail, relative to the guide rail and the mounting element. In this rotational position, the shaft cannot leave the mounting element. When, on the other hand, the shaft is in its normal axial position relative to the mounting element, the shaft and the guide roller are prevented from rotating in said plane.

U.S. Pat. No. 3,552,474 describes an edge guiding arrangement for an overhead sliding door, where the guide consists of a guide rail of rhombic cross-section which is open in one side, the guide means consists of a thin guide roller received in the guide rail without any possibility of rotating about the longitudinal direction of the guide rail, and where the joint to the panel edge portion consists of a shaft carrying the guide roller and axially slidably received in a horizontal groove in the panel edge portion, a compression spring being mounted between the bottom of the groove and the end of the shaft to enable the door leaf to move towards and away from the guide rail.

Prior-art edge guiding arrangements of the above-mentioned types suffer from the drawback of not being impact-resistant, i.e. they are normally broken if the door is subjected to a sufficiently great impact. This may cause damage to the guide rollers, the roller shafts, the guides, the hinges at the panel edges and to the panels themselves. This means that the door cannot be used for a certain period of time and that costly and time-consuming repairs are required.

OBJECTS AND SUMMARY OF THE INVENTION

The invention has for its object to provide an improved edge guiding arrangement that does not suffer from these drawbacks.

Thus, the object of the invention is to provide an edge guiding arrangement of the type described by way of introduction which is not damaged if the door is bumped into or subjected to any other impact.

Especially, the invention has for its object to provide an edge guiding arrangement which is sufficiently resistant to withstand impacts without being damaged, and which ensures continued operation of the door when this is bumped into or subjected to a similar impact, without normally necessitating any manual restoring of the door function.

A special object of the invention is to provide an edge guiding arrangement satisfying the above-mentioned objects, both in the case where an impact takes place in the vicinity of the side edges of the door, and in the case where such an impact takes place towards the door centre.

Another object of the invention is to provide an edge guiding arrangement which also permits operating the door at high closing and opening speeds.

To achieve these and other objects, the invention provides, according to a first aspect thereof, an edge guiding arrangement of the type described by way of introduction, which is characterised in that the joint between the guide means and the panel is flexible in said plane in the sense that the panel is rotatable relative to the guide means in said plane and displaceable towards and away from the guide means in said plane, and that the edge guiding arrangement comprises a means which is adapted to resiliently counteract rotation of the panel relative to the guide means in said plane, and to resiliently counteract displacement of the panel in a direction away from the guide means in said plane.

Owing to these distinctive features, the edge guiding arrangement according to the invention will exhibit a resilient flexibility, which means that the side edges of the panels can execute new motions relative to both the guide and the guide means that prevent any damage from occurring if the door is bumped into or subjected to a similar impact.

Since the panel is rotatable relative to the guide means in said plane, the edge guiding arrangement is able to efficiently compensate for impacts occurring close to the door edges. The corresponding edge portion of the panel can then be displaced substantially linearly in the direction of impact, in that the guide means is able to rotate relative to the guide in the direction of impact, at the same time as the panel is able to rotate relative to the guide means in the opposite direction, which thus enables parallel displacement of the panel in the direction of impact.

Since the panel is also displaceable towards and away form the guide means in said plane, the edge guiding arrangement can efficiently compensate for heavier deflections/displacements of the panels, where such a flexibility of the joint allows a temporary increase of the distance between the panel edge and the guide means in said plane.

Irrespective of which motion (rotation, displacement or rotation+displacement) is required in the joint between the guide means and the panel, such a rotation or displacement is resiliently counteracted by a means included in the edge guiding arrangement of the invention. Said means, which may consist of a single element, such as a helical spring, or of several separate elements, ensures efficient restoring of the door if bumped into or subjected to a similar impact.

The rotatability of the guide means about the guide may preferably be achieved by the guide being substantially cylindrical or tubular and by the guide means comprising a guide groove mating with the guide and extended perpendicular to said plane. As another preferred feature of the invention, the guide groove of the guide means may in this case be open at its side facing away from the panel to permit the guide means to be disengaged from the guide upon a sufficiently great impact on the door.

According one embodiment of the invention, the engagement between the guide means and the guide may be such that the guide means, if rotated a predetermined angle in said plane relative to the guide, can be disengaged from the guide. According to this embodiment, a kind of two-stage action of the edge guiding arrangement is achieved. In the case of a relatively limited force of impact, the guide means will still be engaging the guide, and the displacement and/or angular change of the panel caused by the impact may then be compensated for by (i) the rotatability of the guide means in the guide and/or (ii) the flexibility of the joint in said plane. However, if the force of impact is sufficiently high, the displacement of the panel in the direction of impact will cause the guide means to be angled to such an extent relative to the guide that the guide means is released from its engagement with the guide and can leave this. This embodiment of the invention thus prevents the occurrence of damage to the edge guiding arrangement in the case where the impact on the door is too great to be compensated for by the movability of the edge guiding arrangement, while retaining the ability of the edge guiding arrangement to restore the door function for continued operation after a less substantial impact. Preferably, the above-mentioned "release function" exists irrespective of the direction in which the guide means is rotated relative to the guide.

These and other preferred features of this first aspect of the edge guiding arrangement according to the invention are recited in claims 1–12.

According to a second aspect of the invention, there is provided an edge guiding arrangement for a door having a plurality of mutually rotatable panels which are extended between and movable along two elongate guides at opposite edge portions of the panels, the edge guiding arrangement comprising such a guide and a guide means connected to an edge portion of the panel, the guide means engaging the guide and being movable along and rotatable about the guide, the edge guiding arrangement being characterised in that the engagement between the guide means and the guide is such that the guide means, if rotated a predetermined angle about the guide, can be disengaged therefrom.

This second aspect of the invention and preferred embodiments thereof are recited in claims 13–22.

According to this second aspect of the invention, the edge guiding arrangement may preferably, but not necessarily, exhibit, in addition to the features relating to the release function of the guide means, a flexibility of the joint between the guide means and the panel. This second aspect of the invention encompasses both the possibility of the flexibility allowing only rotation of the panel relative to the guide means in a plane perpendicular to the guide, and the possibility of the flexibility allowing only displacement of the panel towards and away from the guide means in said plane, as well as the possibility of the flexibility allowing both such rotation and such displacement. In all the cases, means may be provided for counteracting such a rotation and such a displacement. However, it is also conceivable to arrange the panel rigidly connected to the guide means without using any flexible joint of the type described above.

BRIEF DESCRIPTION OF THE DRAWINGS

These and other features and advantages of the invention will appear from the following detailed description of two exemplary, non-limiting embodiments of the invention, with reference to the accompanying drawings.

DETAILED DESCRIPTION OF THE PREFERRED EMBODIMENTS

Figure 1:
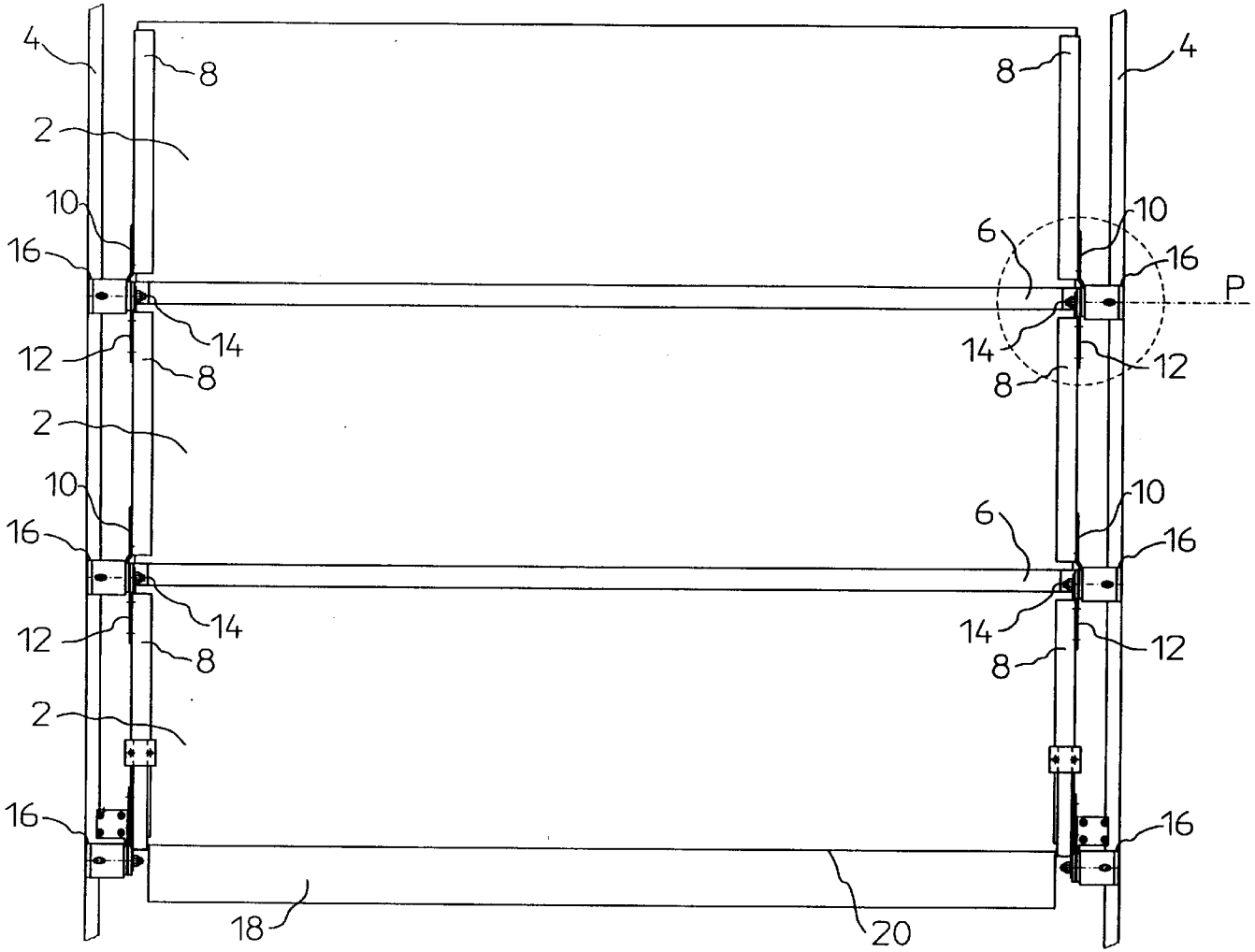
FIG. 1 is a front view of the lower part of a door provided with edge guiding arrangements according to the invention.

FIG. 1, to which reference is now made, illustrates the three lowermost panels 2 of an overhead sliding door. The panels 2 are extended between and movable along two elongate guides 4 and are mutually rotatable along continuous link elements 6, which may preferably be of the type described in the above-mentioned Swedish patent application entitled "Door panel", which has the same filing date as the present application and to which reference is now made for further details, especially in respect of the panels 2 and the link elements 6, which in accordance with said copending application are both preferably made of flexible material, and where the link elements 6 are characterised by being dividable when subjected to an impact. Each link element 6 defines an axis of rotation A (see FIG. 2C) coinciding with the plane P indicated in FIG. 1.

At their side edges, the panels 2 are fixedly connected to edge sectional elements 8 supporting, at their upper and lower ends, upper and lower hinge plates 10 and 12, respectively, for rotatable interconnection of adjoining panels 2. Opposite upper and lower hinge plates 10 and 12 are rotatably held together by a hinge pin 14, which is extended in the plane P and which, at its end facing away from the panels 2, is rotatably connected to a guide means 16. The guide means 16 engages and is movable along a corresponding guide 4. FIG. 1 also illustrates a sealing device 18, known per se, at the bottom edge 20 of the lowermost panel 2.

The lower part of the door leaf may preferably be designed with a pivotal bottom panel of the type described in the applicant's Swedish patent application entitled "Bump-resistant door", which has the same filing date as the present application and to which reference is here made for further details on the mounting of the lowermost panel and on the connection of the drive and balancing means for the lower part of the door leaf.

Figure 2C:
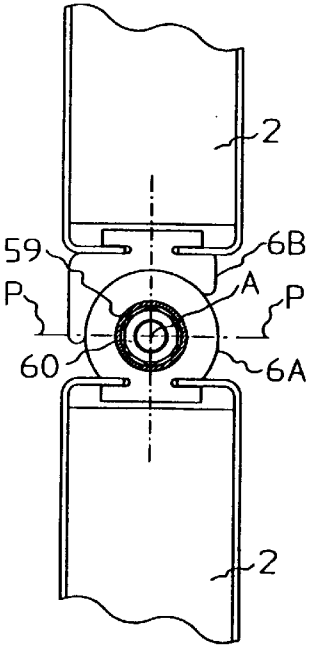
FIG. 2C is a cross-section taken along line 2C—2C in FIG. 2A.
Figure 2B:
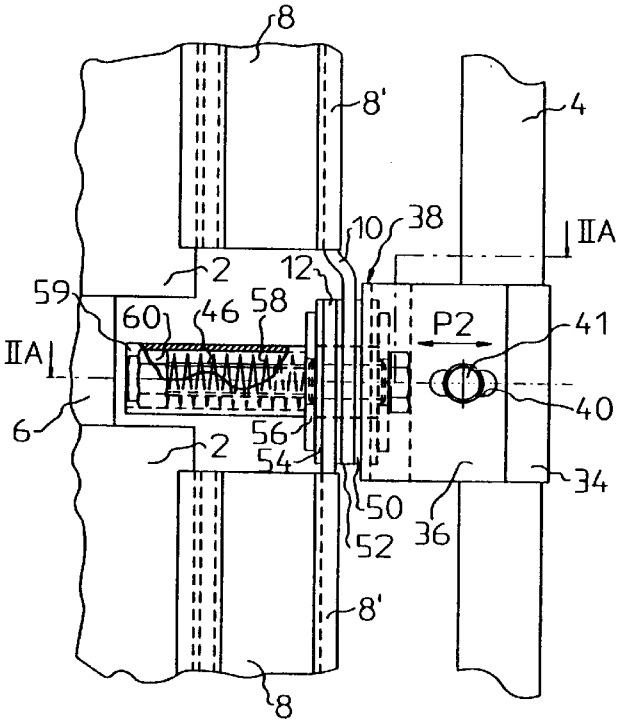
FIG. 2B is a side view taken along line IIB—IIB in FIG. 2A.
Figure 2A:
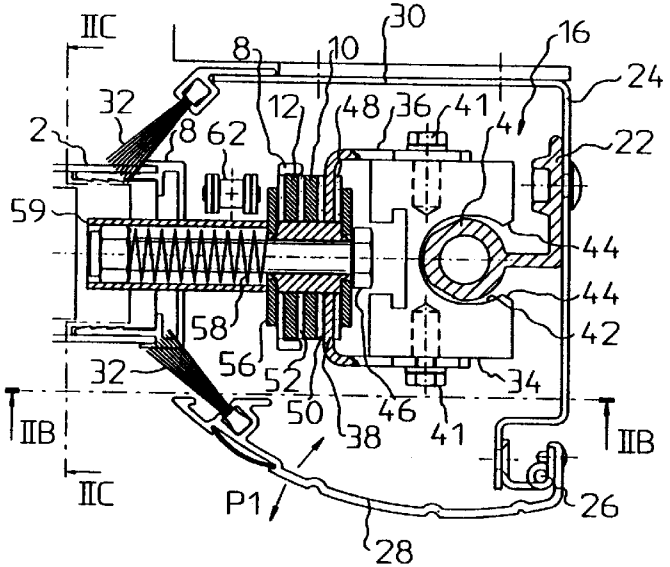
FIG. 2A is a sectional view of one embodiment of an edge guiding arrangement according to the invention, taken along line IIA—IIA in FIG. 2B.

Reference is now made to FIGS. 2A–C, showing on a larger scale the portion in FIG. 1 marked by a dashed circle C, comprising an edge guiding arrangement according to the invention.

The edge guiding arrangement includes a guide 4, a guide means 16, and a joint between the guide means 16 and a side edge portion of the panel 2.

As shown in FIG. 2A, the guide 4 is substantially tubular and is fixed, by the intermediary of an angled mounting element 22 integral with the guide 4, to a lateral sectional element 24 which supports, via a hinge 26 provided at the lower edge in the Figure, a cover sectional element 28 pivotal in the direction of the double arrow P1, and which passes on the opposite side of the door into a fixed cover sectional element 30, such that the lateral sectional element 24, the pivotal cover sectional element 28 and the fixed cover sectional element 30 together form a vertically extended, open-side casing for the edge guiding arrangement. As shown in FIG. 2A, sealing brushes 32 are provided at the ends of the cover sectional elements 28, 30 for sealing against the panels 2.

The guide means 16 comprises a guide block 34, which may be made of any suitable, wear-resistant material having good sliding properties, and a U-shaped mounting element 36, the base 38 of which is located between the guide block 34 and the panel 2. As best seen in FIG. 2B, an oblong screw hole 40 is provided in each of the shanks of the mounting element 36, and in each hole 40 is mounted a screw 41 for securing the mounting element 36 to the guide block 34. Thanks to the holes 40 being oblong, the mounting element 36 is movable in relation to the guide block 34 in the direction of the double arrow P2, as indicated in FIG. 2B. The main purpose of this is to facilitate adjusting the position of the guide block 34 relative to the guide 4 during mounting and in normal operation, but this possibility of a relative movement between the U-element 36 and the guide block 34 can also be used to compensate for an impact on the door.

In its side facing away from the panel 2, the guide block 34 has a guide groove 42 mating with the guide 4. The groove 42 is open sideways and its lateral opening is defined by two opposing lugs 44. The guide groove 42 is so designed that the guide means 16 can rotate about the guide 4 in the plane P, when the guide 4 is received in the guide groove 42, as shown in FIG. 2A. When the guide means 16 has the normal angular orientation relative to the guide 4, as shown in FIG. 2A, the lugs 44 prevent the guide 4 from leaving the guide groove 42.

The flexible joint between the guide means 16 and the panels 2 will now be described. In its base 38, the U-element 36 has a through hole accommodating a screw 46, whose diameter is smaller than that of the hole, so that there is a radial play, and whose centre axis substantially coincides with the plane P. The screw head engages the base 38 of the U-element 36 via a washer 48 and thus serves as a stop to prevent the screw 46 from leaving the U-element 36.

Between the base 38 of the U-element 36 and the panels 2, there are mounted on the screw 46 in succession: a washer 50, an upper hinge plate 10 fixed to the edge sectional element 8 of the upper of two adjoining panels 2, a washer 52, a lower hinge plate 12 fixed to the edge sectional element 8 of the lower of two adjoining panels 2, two washers 54 and 56, a helical compression spring 58, and a locking nut 60. The compression spring 58 and the locking nut 60 are enclosed by a sleeve 59.

The edge sectional elements 8 mounted on the panels 2 are substantially I-shaped, the flange 8' of the I facing the guide means 16 being formed with a groove, in which an upper and a lower hinge plate 10 and 12, respectively, are mounted by screwing. Reference numeral 62 in FIG. 2A designates a drive and balancing chain, the lower end of which is attached adjacent the lowermost of the panels 2.

FIG. 2C shows the design of the continuous, flexible link element 6, which is composed of a male sectional element 6A connected to a lower panel 2 and having a convex sliding surface, and of a female sectional element 6B connected to an upper panel 2 and having a mating, concave sliding surface. The sectional elements 6A, 6B together define an axis of rotation A of the panels 2 coinciding with the plane P.

Figure 3:
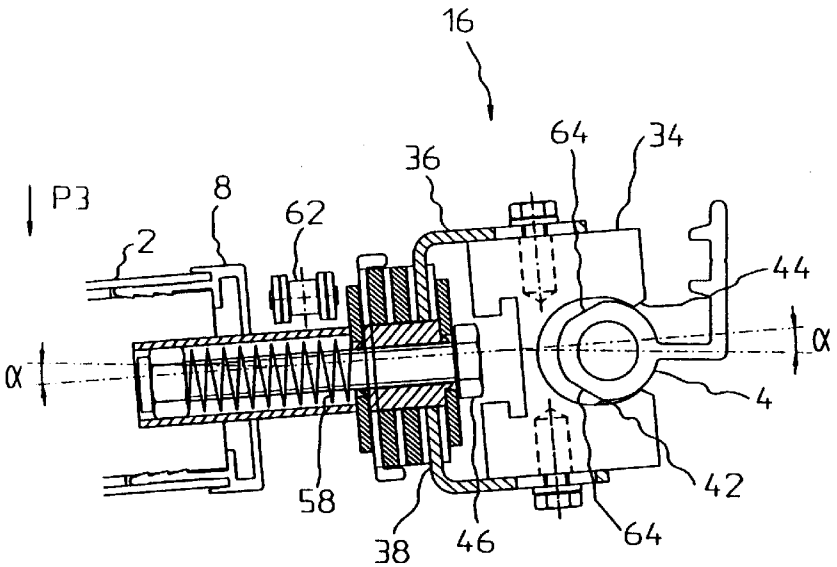
FIG. 3 shows the function of the edge guiding arrangement in FIGS. 2A–C when the door is subjected to an impact occurring relatively far away from the door edge.

FIG. 3 shows the function of the edge guiding arrangement in FIGS. 2A–C in the case of an impact occurring relatively far away from the door edge. The central portion of the panel 2 is displaced by the impact a certain distance in the direction of impact P3, and the panel or panels 2 with the associated link elements 6 subjected to the impact will bulge in the direction of impact. As shown in FIG. 3, the side edge portions of the panels 2 will be inclined an angle a relative to the normal position in FIG. 2A, and thanks to the guide means 16 being rotatable relative to the guide 4 in the plane P, the guide means 16, as shown in FIG. 3, can rotate in the same direction and through the same angle $\alpha$ relative to the guide 4. The deflection of the panel 2 means that the distance between the side edge portion of the panel 2 and the guide 4 will increase slightly. In FIG. 3, this increased distance will be compensated for by the guide 4 having been displaced to the right in the guide groove 42 into abutment against one stop lug 44. In the case of a heavier deflection of the panel in the direction of the arrow P3, the joint between the guide means 16 and the panel 2 will be lengthened in the direction of the screw 46 against the resilient force produced by the spring 58, and a play will arise between the hinge plates 10, 12, on the one hand, and the base 38 of the U-element 36, on the other. In the case of such a heavier deflection, the angle $\alpha$ will also increase somewhat. Irrespective of whether the spring 58 is activated or not in FIG. 3, the edge guiding arrangement will be reset to its normal state shown in FIG. 2A, when the deflection of the panel 2 does not prevail any more.

If, in FIG. 3, a yet heavier deflection of the panel 2 in the direction of the arrow P3 occurs, the angle $\alpha$ of the guide means 16 relative to the guide 4 will become so substantial that the engagement of the guide means 16 with the guide 4 is abolished. This effect is achieved by the guide 4 being provided with two flat, opposing surfaces 64 which together define a narrower portion of the guide 4. In the case of a sufficiently great rotation of the guide means 16 relative to the guide 4 (in an optional direction), this narrower portion of the guide 4 will be able to leave between the stop lugs 44.

If the guide means 16 is disengaged from the guide 4 as described above, the pivotal cover sectional element 28 may, if required, be automatically removed by the action of the guide means 16.

Figure 4:
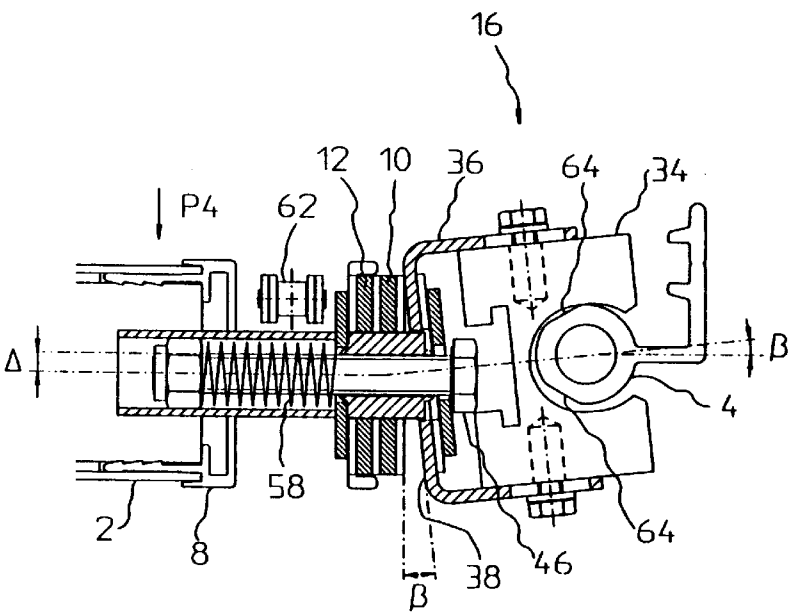
FIG. 4 shows the function of the edge guiding arrangement in FIGS. 2A–C when the door is subjected to an impact occurring relatively close to the door edge.

FIG. 4 shows the function of the edge guiding arrangement in FIGS. 2A–C upon an impact occurring relatively close to the door edge. The edge portion of the panel 2 is displaced during the impact a certain distance Δ in the direction of impact P4, and the panel or panels 2 with the associated link elements 6 will then be substantially parallel-displaced in the direction of impact P4. As opposed to the case of FIG. 3, no essential angular change of the panel 2 takes place in the case of FIG. 4. As shown in this Figure, the guide means 16 will however, as in FIG. 3, rotate an angle β relative to the guide 4, but in FIG. 4 the panel 2 will undergo an essentially equally large rotation β, however in the opposite direction, relative to the guide means 16, since the screw 46 can be inclined relative to the U-element 36 against the force produced by the compression spring 58. In the case of a greater displacement in the direction of the arrow P4, the joint between the guide means 16 and the panel 2 may, as in FIG. 3, be lengthened further in the direction of the screw 46 against the resilient force produced by the spring 58, and a greater play would arise between the hinge plates 10, 12, on the one hand, and the base 38 of the U-element 36, on the other. As in FIG. 3, the edge guiding arrangement in FIG. 4 will be reset to its normal state shown in FIG. 2A, when the displacement of the panel 2 does no longer prevail.

The "release function" described with reference to FIG. 3 and activated in the case of a sufficiently large angle of rotation of the guide means 16 relative to the guide 4, obviously also applies to the case of FIG. 4.

It is understood that the force exerted by the spring 58 can be adjusted by adjusting the position of the locking nut 60 on the screw 46.

The illustrated embodiment can be modified such that the end of the screw 46 and the sleeve 59 extends into a central opening of the link element 6, whereby the sleeve and the screw will be guided. In this case, the ends of the link element 6 may optionally extend farther out towards the side edges of the door leaf than is shown in FIGS. 1 and 2B.

Figure 5:
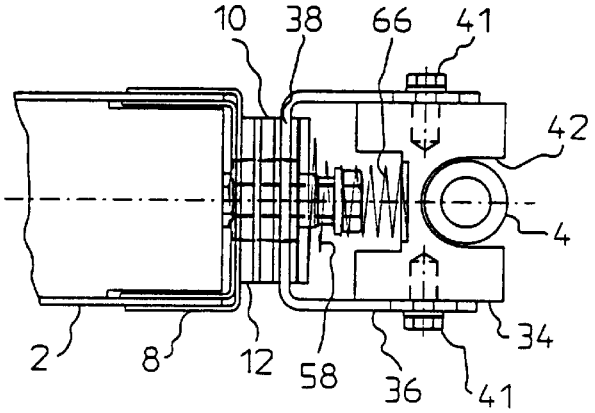
FIG. 5 shows another embodiment of an edge guiding arrangement according to the invention.
Figure 6:
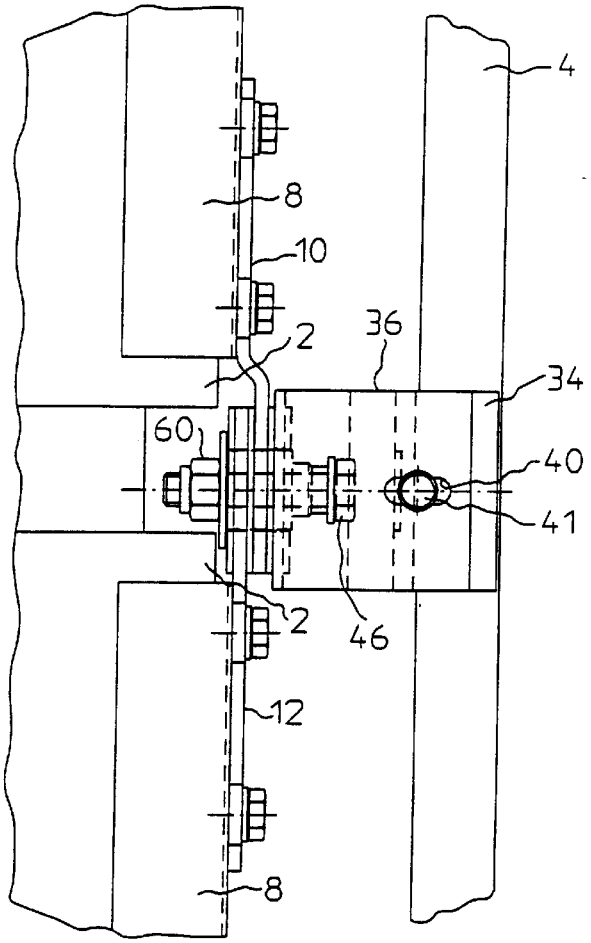
FIG. 6 is a lateral sectional view of the embodiment in FIG. 5.

FIGS. 5 and 6 show a variant of the edge guiding arrangement according to the invention. For greater simplicity, the parts included in FIGS. 5 and 6 bear the same reference numerals as corresponding parts in the embodiments of FIGS. 2A–C described above.

This variant differs from the embodiment previously described primarily in that the spring 58 is now mounted between the head of the screw 46 and the base 38 of the U-element 36. In this manner, the spring 58 is protected to a greater extent by the U-element 36. Moreover, the spring 58 is conical with a gradually increasing diameter of its turns, yielding the advantage that the spring can be maximally compressed. It is understood that the spring 58 in FIGS. 5 and 6, like the spring 58 in FIGS. 2A–C, acts so as to urge the hinge plates 10, 12 into engagement with the U-element 36.

The embodiment of FIGS. 5 and 6 further includes a second compression spring 66 which is mounted between, on the one hand, the head of the screw 46 and, on the other hand, the guide block 34. This second compression spring 66 serves to hold the guide block 34, displaceable relative to the U-element 36, engaged with the guide 4, for which reason the stop lugs 44 and the two flat, opposing surfaces 64 of the guide 4 have both been dispensed with in the embodiment of FIGS. 5 and 6.

The following modifications of the illustrated embodiments are conceivable within the scope of the invention. The compression spring 58 can be replaced by one or more resilient elements, such as Belleville spring washers, tension springs, elastomeric elements or the like. Nor is the above-mentioned "release function", which is activated upon a sufficiently considerable rotation of the guide means 16, a compulsory feature of the first aspect of the invention.

According to the second aspect of the invention, the edge guiding arrangement comprises at least the "release function" and preferably, but not necessarily, also the flexibility of the joint between the guide means and the panel. Thus, according to the second aspect of the invention, the panels 2 or edge sectional elements 8 thereof may be directly and rigidly connected to the guide means 16, for example the base 38 of the mounting element 36, in which case the intermediate elements for providing flexibility are dispensed with and replaced, for example, by bolt joints or the like.

We claim:

1. A door, comprising::

(a) two mutually spaced, elongate stationary guides;

(b) a plurality of mutually rotatable door panels, each of which extends between and is movable along said stationary guides, and each of which presents a main panel and two opposite panel edge portions located at said stationary guides; and (c) a plurality of individual panel edge guide arrangements, which are spaced along said panel edge portions for guiding the panels along said stationary guides, wherein each one of said panel edge guide arrangements including:

(c1) a guide member which engages and is movable along one stationary guide of said two stationary guides and which guide member is rotatable relative to said one stationary guide in a rotational plane (P) perpendicular to a longitudinal direction of said one stationary guide; and (c2) a flexible joint arranged between and holding together said guide member and one panel of said panels, said joint being flexible in such a manner that (i) said one panel is rotatable in said rotational panel relative to the guide member about an axis parallel with said one stationary guide such that the main plane of said one panel during such a rotation is angled relative to a normal position of said main plane (P), and (ii) said one panel also is displaceable towards and away from the guide member in said rotational plane (P), and (c3) a counteracting means which is adapted to (i) resiliently counteract rotation of said one panel relative to the guide member in said rotational plane (P) in a direction away from said normal position, and (ii) to resiliently counteract displacement of said one panel in a direction away from the guide member in said plane (P).

2. A door as claimed in claim 1, further comprising stop means for defining a maximum permissible displacement of said one panel in a direction away from the guide member in said rotational plane (P).

3. A door as claimed in claim 1 or 2, wherein said counteracting means consists of a helical spring extended in said rotational plane (P).

4. A door as claimed in claim 3, wherein said helical spring is a compression spring.

5. A door as claimed in claim 1 or 2, wherein said counteracting means is an elastomeric element.

6. A door as claimed in claim 1 wherein said flexible joint comprises a hinge having two hinge plates each fixed to a respective edge portion of two adjoining panels, and a hinge pin which pivotably interconnects the hinge plates and which is parallel to said rotational plane (P) and which is flexibly connected to the guide member to provide said flexible joint between said one panel and the guide member.

7. A door as claimed in claim 6, wherein said counteracting means comprises a helical spring mounted so as to surround to said hinge pin in order, by its resilient force, to urge said one panel and the guide member towards each other in said rotational plane (P).

8. A door as claimed in claim 7, wherein:

the guide member comprises a mounting element which is provided between said one stationary guide and the hinge plates and which mounting element has a through hole in which the hinge pin is received with a play with respect to a periphery of the through hole, the hinge pin is provided, at its end facing said one stationary guide, with a first abutment preventing it from leaving the through hole, and the hinge pin, on its side facing away from the guide member, is extended by a spring-carrying portion which has a second abutment at its end facing away from the hinge plates and which, between this second abutment and the hinge plates, is surrounded by said compression spring, which thus urges the hinge plates towards the guide member.

9. A door as claimed in claim 1, wherein said stationary guides are essentially cylindrical, and wherein said the guide member comprises a guide recess mating with said one stationary guide and extended at right angles to said rotational plane (P).

10. A door as claimed in claim 9, wherein said guide recess of the guide member is open at its side facing away from said one panel, so that the guide member can be disengaged from said one stationary guide upon a sufficiently great impact on the door.

11. A door as claimed in claim 10, wherein the engagement between the guide member and said one stationary guide is such that the guide member, if rotated in the rotational plane (P) a predetermined angle about said one stationary guide, can be disengaged from said one stationary guide.

12. A door as claimed in claim 11, wherein said guide recess of the guide member is provided at its open side with inwardly directed lugs, normally preventing said one stationary guide from leaving said guide recess, and wherein said stationary guides are so designed that, if the guide member is rotated said predetermined angle in said rotational plane (P) relative to said one stationary guide, said one stationary guide can pass out of the guide recess between said lugs.

13. A door comprising two mutually spaced, elongate stationary guides, a plurality of mutually rotatable panels which are extended between and movable along two elongate said stationary guides at opposite edge portions of the panels, a plurality of panel edge guiding arrangement, each of which comprises one stationary guide of said two stationary guides in combination with a guide member connected to an edge portion of one panel of said plurality of panels by a joint, wherein the guide member is in engagement with and is being movable along and rotatable about said one stationary guide, and wherein the guide member has a guide recess, in which said one stationary guide is slidably received and which guide recess is open at its side facing away from said one panel and wherein the engagement between the guide member and said one stationary guide is such that the guide member, when rotated past a predetermined angle about said one stationary guide due to a sufficiently great impact on the door, can be disengaged from said one stationary guide without permanent material deformation by passing out of the guide recess.

14. A door as claimed in claim 13, wherein said guide recess of the guide member is provided at its open side with inwardly directed lugs, normally preventing said one stationary guide from leaving the guide recess, and wherein said one stationary guide is so designed that, when the guide member is rotated said predetermined angle relative to said one stationary guide, said one stationary guide can pass out of the guide recess between said lugs.

15. A door as claimed in claim 13 or 14, wherein said joint is flexible in a plane (P) perpendicular to a longitudinal direction of said one stationary guide.

16. A door as claimed in claim 15, wherein said joint is flexible in the sense that said one panel is rotatable relative the guide member in said plane (P).

17. A door as claimed in claim 16, wherein each one of said edge guiding arrangements further comprises a counteracting means for resiliently counteracting rotation of said one panel relative to the guide member in said plane.

18. A door as claimed in claim 15, wherein said joint is flexible in the sense that said one panel is displaceable towards and away from the guide member in said plane (P).

19. A door as claimed in claim 18, wherein each one of said edge guiding arrangements further comprises a counteracting means for resiliently counteracting the displacement of said one panel in a direction away from the guide member in said plane (P).

20. A door as claimed in claim 15, wherein said joint is flexible in the sense that said one panel is rotatable relative to the guide member in said plane (P) as well as displaceable towards and away from the guide member in said plane (P), and wherein each one of said edge guiding arrangements further comprises a counteracting means which is adapted to resiliently counteract the rotation of said one panel relative to the guide member in said plane (P), and to resiliently counteract the displacement of said one panel in a direction away from the guide member in said plane (P).

21. A door as claimed in claim 13, wherein said one panel is rigidly connected to the guide member.

* * * * *

UNITED STATES PATENT AND TRADEMARK OFFICE

CERTIFICATE OF CORRECTION

PATENT NO. : 5,829,504

DATED : November 3, 1998

INVENTOR(S) : Ekstrand et al.

It is certified that error appears in the above-identified patent and that said Letters Patent is hereby corrected as shown below:

Claim 1, Column 8:

line 19, please change the first occurence of "panel" to --plane--;
line 35, please change "rotational panel" to --rotational plane (P)--;
line 40, please delete "(P)";
line 49, after "said", please insert --rotational--.

Signed and Sealed this

Fifteenth Day of June, 1999

*Attest:*

Q. TODD DICKINSON

*Attesting Officer*

*Acting Commissioner of Patents and Trademarks*